US005434002A

United States Patent [19]

Yoon et al.

[11] Patent Number: 5,434,002

[45] Date of Patent: Jul. 18, 1995

[54] NON-SPUN, SHORT, ACRYLIC POLYMER, FIBERS

[75] Inventors: Han S. Yoon; Tae W. Son; Chul J. Lee; Byung G. Min, all of Seoul; Jae W. Cho, Anyang, all of Rep. of Korea

[73] Assignee: Korea Institute of Science and Technology, Seoul, Rep. of Korea

[21] Appl. No.: 148,629

[22] Filed: Nov. 8, 1993

Related U.S. Application Data

[63] Continuation-in-part of Ser. No. 709,872, Jun. 4, 1991, abandoned.

[30] Foreign Application Priority Data

Jun. 4, 1990 [KR] Rep. of Korea ..... 90-8334

[51] Int. Cl.[6] ..... D02G 3/00

[52] U.S. Cl. ..... 428/357; 428/364; 428/359; 428/394

[58] Field of Search ..... 102/157.4, 157.3, 157.2; 428/364, 357, 359, 394; 264/206

[56] References Cited

U.S. PATENT DOCUMENTS

| | | | |
|---|---|---|---|
| 3,991,153 | 11/1976 | Klausner et al. | 264/206 |
| 4,421,708 | 12/1983 | Reichardt et al. | 264/206 |
| 4,446,206 | 5/1984 | Fester et al. | 428/364 |
| 4,515,859 | 5/1985 | De Maria et al. | 428/364 |
| 4,535,027 | 8/1985 | Kobashi et al. | 428/364 |
| 4,861,659 | 8/1989 | Takada et al. | 428/364 |
| 4,902,452 | 2/1990 | Nishihara et al. | 264/206 |
| 5,219,501 | 6/1993 | Yoon et al. | 264/85 |

*Primary Examiner*—N. Edwards

*Attorney, Agent, or Firm*—Oblon, Spivak, McClelland, Maier & Neustadt

[57] ABSTRACT

A non-spun fiber of acrylic polymers, characterized by a pulp-like short fiber form of a thickness distribution of 0.1 to 100 μm and a length distribution of 0.1 to 100 mm, and by irregular cross-sections in a plane taken perpendicular to the fiber axis and needle point-like ends similar to those of natural wood pulp fibers. The acrylic fiber of the present invention is made of an acrylonitrile homopolymer or copolymer consisting of a least 70% acrylonitrile (by weight) and at most 30% copolymerizable monomers (by weight) and having a viscosity average molecular weight between 10,000 to 600,000. The acrylic fiber according to the invention is further featured by the following physical properties: a degree of orientation of more than 80% based on X-ray diffraction pattern data, a tensile strength of 3 to 10 g/denier and an initial modulus of 30 to 100 g/denier, and absolutely no cylindrically-shaped filament trunks.

3 Claims, 11 Drawing Sheets

NON-SPUN, SHORT, ACRYLIC POLYMER, FIBERS

CROSS REFERENCE

This application is a continuation-in-part of U.S. patent application Ser. No. 07/709,872 filed Jun. 4, 1991, is now abandoned.

FIELD OF THE INVENTION

The present invention relates to a novel, pulp-like, highly-oriented, short fiber of acrylic polymers which can be mixed completely with natural wood pulp fibers. More particularly, the invention relates to a novel, highly-oriented, short fiber of acrylic polymers having a fibrous structure of high molecular orientation produced from polyacrylonitrile (PAN), by a simple non-spun extrusion of a melt of PAN and water.

BACKGROUND OF THE INVENTION

So far, there have been no synthetic pulps which can be obtained more economically than natural pulp. Up to now, all techniques for obtaining synthetic pulps rely on a conventional fiber-making process which is comprised of various steps such as dissolving polymers, spinning, coagulating, drying, drawing as-spun filaments, recycling solvents, and additional measures which serve to reduce the resulting pollutants. Thus, the economical load undertaken to produce synthetic pulps is inevitably very large.

Acrylic fibers have been used in materials for clothing, as well as more recently, in industrial materials, for example, as a substitute fiber for asbestos, a heat insulating and resisting fiber, a cement reinforcing fiber and the like. Acrylic fibers used in industrial materials should be produced in the form of a short fiber.

It is well known that PAN exists in the form of a conglomerated particle in which the molecular chains of PAN are twisted into an irregular helix due to the flexibility of skeleton chains and the strong polarity of nitrile groups in the side chains thereof (See F. G. Frushour et al., Handbook of Fiber Science and Technology, Volume IV, Fiber Chemistry, pp. 171–370, ed. by M. Lewin and E. M. Pearce, Marcel Dekker, Inc., 1985). If a strong polar solvent, such as dimethylformamide, dimethylacetamide, dimethyl-sulfoxide, or an aqueous NaSCN solution, an aqueous $ZnCl_2$ solution, or an aqueous $HNO_3$ solution, is added to such polymers, the nitrile groups attract the solvent molecules to couple therewith, and thereby are separated from each other to form a fluid solution. The resulting solution is extruded through the microholes of a spinning die. After the solvent is removed, PAN is solidified to form fibers. However, the molecular chains in the solidified PAN still exist in the conglomerated state, while maintaining the form of a non-oriented lump.

Therefore, although the filaments take the form of a fiber immediately after spinning, when the solvent is removed and the filaments are dried, the PAN molecular chains in the filaments reconglomerate to form a non-oriented lump since the internal molecular chains of the resulting filaments are not oriented at all. Accordingly, it is necessary to draw the resulting filaments in a high ratio (5 to 30, or more) in order to obtain a complete fibrous structure in which the molecular chains are arranged in parallel with the fiber axis. As the filaments are drawn, the non-oriented, conglomerated PAN molecular chains disentangle, extend, and are arranged in parallel with each other, thereby forming fibers having an extended chain crystal region. Therefore, the drawing step is indispensable in the prior techniques for producing fibers since the fiber structure, in which most of the molecular chains are oriented in parallel with the fiber axis, can be obtained only by the drawing operation.

Conventionally, short fibers have been produced in the form of a staple by first forming a long fiber through a solution spinning process using a solvent, and then drawing and cutting the resulting long fiber into staples.

However, the solvents used are now recognized as contributing to environmental pollution. Moreover, the complicated steps of extracting, recovering and purifying the solvents, as well as the maintenance of anti-pollution facilities, increase production costs. Further, the filament thus formed appears to be a fiber, but it still remains substantially unoriented. Accordingly, the filaments thus obtained must be subjected to drawing in a high stretch ratio of between 5 to 30 in order to afford a complete fibrous structure in which the molecular chains are arranged in parallel with the axis of the fiber. This drawing may also increase production costs.

In the case of an acrylic fiber having large surface areas, the process for manufacturing the same involves the more complicated steps of providing a spinning solution, spinning the solution, solidifying the spun filament, removing and recovering the solvent used, drawing and cutting the filament, fibrillizing the resulting fiber, and so forth.

In general, the acrylic fibers prepared by the prior art techniques are inadequate as spun yarns due to their poor elasticity and slippery surface. Further, they are not satisfactory in terms of their reinforcing, heat insulating, and binding properties which are required of industrial materials.

In order to solve the problems mentioned above, it has been suggested to prepare a PAN hydrate using water in place of the hazardous solvents. For example, U.S. Pat. No. 2,585,444 teaches that PAN fibers can be formed by heating a hydrate of PAN, containing 30% to 85% water (by weight), to its melting temperature or higher to give a melted fluid, and then spinning the resulting melt. U.S. Pat. Nos. 3,896,204 and 3,984,601 disclose a process for the production of fibers which comprises heating a mixture of PAN and about 20% to 30% water (by weight) to a temperature ranging from 175° C. to 205° C., to give an amorphous melt, and spinning the resulting melt to form filaments which are then drawn to five times their original length. It is also described in the above patents that when the content of acrylonitrile in PAN is as low as 80%, spinning can be carried out at a temperature range between 140° C. and 170° C.

U.S. Pat. Nos. 3,991,153 and 4,163,770 disclose a process for the production of fibers which comprises spinning a PAN hydrate containing between 10% to 40% water (by weight) at the melting temperature or higher, that is, the temperature range at which the melt of an amorphous single-phase is formed, and then drawing the filaments in a ratio between 25 to 150 in a pressure vessel.

As mentioned above, the prior art processes typically involve the steps of forming and spinning a PAN/$H_2O$ melt. However, since the spinning is carried out within the temperature range at which the melt exists in a random amorphous state, fibers, in which the molecular chains of PAN are highly oriented, cannot be obtained without a subsequent step of drawing in a high draw ratio.

Further, U.S. Pat. Nos. 3,402,231, 3,774,387, and 3,873,508 disclose a fiber production process which comprises forming a PAN/$H_2O$ melt by heating a mixture of PAN with 50% or more water to about 200° C., and then spinning the resulting melt to produce fibers. However, such large amounts of water contained therein, and such high temperatures, provide a random, amorphous PAN/$H_2O$ melt. In addition, the PAN filaments extruded from the melt have a fiber profile, but are in reality, no more than non-oriented, continuous extrudates which do not possess any oriented molecular chains nor fibrous structures.

As mentioned above, the prior art techniques for spinning a PAN/$H_2O$ melt are based on a commonly used process which comprises forming an amorphous melt of the PAN/$H_2O$ mixture by using a large amount of water and temperatures higher than the melting temperature of the PAN/$H_2O$ mixture, or by increasing the content of the comonomers, spinning the resulting amorphous melt to form filaments, and then, drawing the resulting filaments in a high draw ratio to form fibers.

In the conventional techniques for producing filaments, an amorphous melt is obtained by heating the PAN/$H_2O$ mixture to the temperature at which the crystalline phase is broken down, in order to lower the viscosity of the resulting melt for easy spinning operation. Thus, a parallel arrangement of the PAN molecular chains cannot be achieved without a separate step of drawing in a high draw ratio. Furthermore, fibers, for use in making pulp, and which have highly orientated molecular chains, could only be prepared by a process which comprises the following complicated steps: preparing a stock solution in which PAN is dissolved in a solvent, spinning, solidifying, removing and recovering the solvent, drying, drawing, cutting, and fibrillating.

Given the above, we, the present inventors, have further investigated a two-component system comprising PAN and water (hereinafter referred to as the "PAN/$H_2O$ mixture") and unexpectedly found that the PAN/$H_2O$ mixture absorbs the heat of fusion to form a melt of an amorphous, single phase at the melting temperature of the mixture.

The melted single phase, even if cooled to below the melting temperature, is not solidified and maintains its supercooled state until the temperature is cooled to a selected temperature range. When further cooled to below the solidifying temperature (Tc), the melted single phase is solidified and is returned to its original state. However, when the PAN/$H_2O$ melt is cooled to form the supercooled state at a temperature below the melting point, the single phase PAN/$H_2O$ melt forms a metacrystalline phase having a molecular order. Unlike the amorphous melt formed at temperatures above the melting point, the physical properties of the metacrystalline phase are similar to those of a liquid crystal.

That PAN, together with water, forms a metacrystalline phase, in which a liquid crystal structure can be formed by applying only a small shear force at a temperature below the melting temperature of the PAN/$H_2O$ mixture, was first found by the present inventors. This surprising phenomenon makes it easy to produce PAN with a molecular orientation upon simple extrusion, which will be discussed in detail hereinafter. It appears that in the melted metacrystalline phase, the PAN molecular chains, together with the water molecules, form innumerable fine units of a regular phase having the molecular structure of an ordered chain form. The PAN molecular chains in the melted metacrystalline phase have a self-orientating property. Thus, if directional shear forces are applied to the PAN molecular chains in the melted metacrystalline phase, the PAN molecules easily form a highly-oriented fibrous structure. In other words, if the PAN/$H_2O$ melt in the melted metacrystalline phase is extruded, the extended PAN molecular chains align in parallel with each other and the water is spontaneously expelled from the system. As the water is expelled, the PAN molecules are extended so that a fiber structure is formed, thereby producing highly-oriented fibers even without a separate drawing process.

SUMMARY OF THE INVENTION

It is therefore, an object of the invention to provide new pulp-like short fibers having a fibrous structure of high molecular orientation without being spun.

It is another object of the invention to provide non-spun short fibers which can be mixed thoroughly with natural wood pulp fibers and dispersed completely in water, and thus, are suitable for use in the process for producing paper.

Further objects of the present invention will become apparent through reading the remainder of the specification.

These and other objects of the present invention can be accomplished by providing a non-spun fiber of acrylic polymers, characterized by having a pulp-like short fiber form of between 0.1 to 100 $\mu$m in thickness and 0.1 to 100 mm in length, and having: irregular cross-sections in a plane taken perpendicular to the fiber axis, needle point-like ends similar to those of natural wood pulp fibers, and absolutely no cylindrically-shaped filament trunks which result from the application of the spinning process used to make fibers by any method other than this invention. The acrylic fiber according to the invention is further featured by the following physical properties: a degree of orientation of more than 80% based on X-ray diffraction pattern data, a tensile strength of 3 to 10 g/denier and an initial modulus of 30 to 100 g/denier, a complete miscibility with natural wood pulp fibers over the whole mixing range of 1 to 99% ratios and a complete dispersibility in water.

BRIEF DESCRIPTION OF THE DRAWINGS

The present invention is described in detail with reference to the accompanying drawings.

DETAILED DESCRIPTION OF THE INVENTION

Figure 1A:
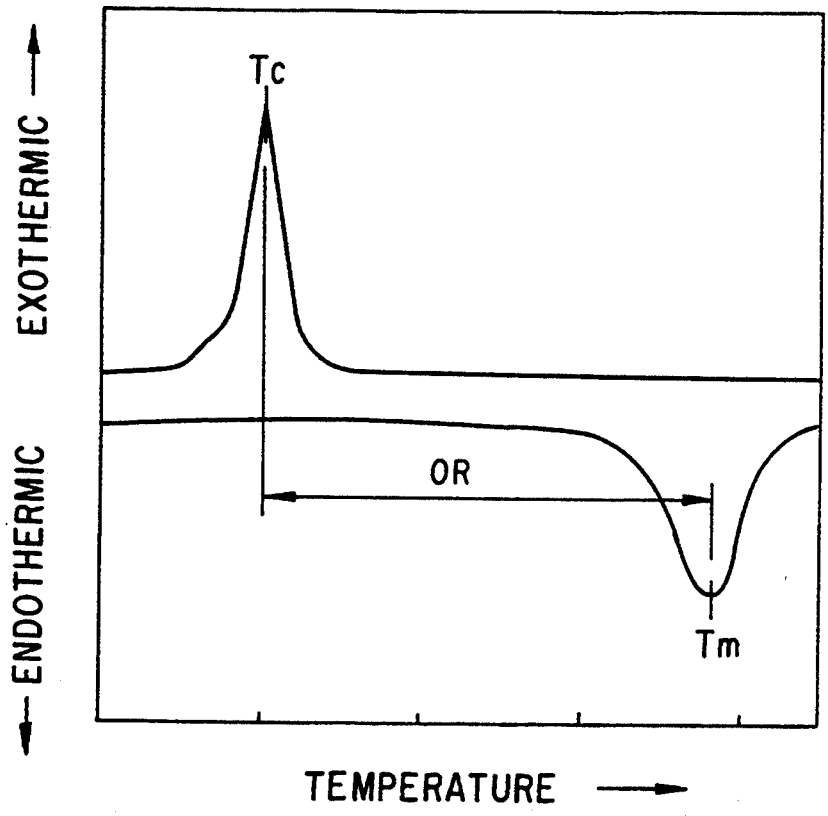
FIG. 1A illustrates a typical melting endothermic peak and a solidifying exothermic peak, observed by a differential scanning calorimetry (DSC), of a PAN/$H_2O$ mixture. The temperature range (OR) wherein the melt of the metacrystalline phase having a molecular order can be formed resides between the melting temperature (Tm) of the PAN/$H_2O$ mixture and the solidifying temperature (Tc) of the melt.

According to the invention, a pulp-like short fiber is provided which has the highly-oriented fibrous structure and a thickness distribution of 0.1 μm to 100 μm and a length distribution of 0.1 mm to 100 mm which fiber is made of PAN having a viscosity average molecular weight of 10,000 to 600,000.

The pulp-like short fiber of the invention is prepared by the following steps:

a) heating a mixture of the PAN with 10 to 100% by weight of water to a temperature above the melting temperature under the hermetically sealed condition to form an amorphous melt;

b) cooling the amorphous melt to a temperature between the melting temperature of the PAN/$H_2O$ mixture and the solidifying temperature of the melt to obtain a melt of the supercooled phase;

c) extruding the resulting supercooled melt through a slit-typed extrusion die at the temperature range between the melting temperature of the PAN/$H_2O$ mixture and the solidifying temperature of the melt to give an extrudate, which has the sectional structure, in which platen fibrils formed by solidification of the extrudate with the spontaneous removal of water from the extrudate after the extrusion are arranged and laminated in such a manner that the dehydration space is retained between the platen fibrils, and the fibrous crystal structure and the degree of orientation of more than 809 based on X-ray diffraction pattern data; and d) beating the resulting extrudate mechanically into an appropriate size to give pulp-like short fibers.

The term "PAN" as used herein refers to both homopolymers of an acrylonitrile and copolymers of an acrylonitrile with one or more monomers copolymerizable with the acrylonitrile. Such copolymers should contain at least 70%, preferably, at least 85% by weight of an acrylonitrile and at most 30%, preferably, at least 15% by weight of a copolymerizable monomer.

Such copolymerizable monomer includes addition-polymerizable monomers containing an ethylenically double bond, such as methyl acrylate, methyl methacrylate, ethyl acrylate, chloroacrylic acid, ethyl methacrylate, acrylic acid, methacrylic acid, acrylamide, methacrylamide, butyl acrylate, methacrylonitrile, butylmethacrylate, vinyl acetate, vinyl chloride, vinyl bromide, vinyl fluoride, vinylidene chloride, vinylidene bromide, allyl chloride, methyl vinyl ketone, vinyl formate, vinyl chloroacetate, vinyl propionate, styrene, vinyl stearate, vinyl benzoate, vinylpyrrolidone, vinylpiperidine, 4-vinyl pyridine, 2-vinyl pyridine, N-vinyl phthalimide, N-vinyl succinimide, methyl malonate, N-vinyl carbazole, methyl vinyl ether, itaconic acid, vinyl sulfonic acid, styrene sulfonic acid, allyl sulfonic acid, methallyl sulfonic acid, vinyl furan, 2-methyl-5-vinyl pyridine, bi/d-H naphthalene, itaconic ester, chlorostyrene, vinyl sulfonate, allyl sulfonate, methallyl sulfonate, vinylidene fluoride, 1-chloro-2-bromoethylene, α-methylstyrene, ethylene, and propylene.

The molecular weight of PAN is given as a viscosity average molecular weight (Mv) calculated from the intrinsic viscosity [η] conventionally determined by using N,N-dimethylformamide as a solvent according to the following equation:

$$]\eta]=3.35\times10^{-4}Mv^{0.72}$$

wherein the intrinsic viscosity [η] is determined at 30° C. in a solution of PAN in N,N-dimethylformamide as a solvent (See T. Shibukawa et al., Journal of Polymer Science, Part A-1, Vol. 6, pp. 147–159, 1968).

The molecular weight of an acrylonitrile polymer used in the invention ranges between 10,000 and 600,000, preferably from 50,000 to 350,000, as an viscosity average molecular weight calculated from the intrinsic viscosity of PAN.

When the PAN/$H_2O$ mixture, which is obtained by adding an appropriate amount of water to PAN, is placed in a pressure vessel and is heated to the melting temperature or higher, an autogenous water vapor pressure is generated and the polymers are associated with water to form a PAN/$H_2O$ melt. At this time, an inert gas, such as nitrogen or argon, may be introduced into the container to maintain the container in a pressurized state. The heating temperature must reach the melting temperature (Tm) or higher as indicated in FIG. 1A.

Figure 2A:
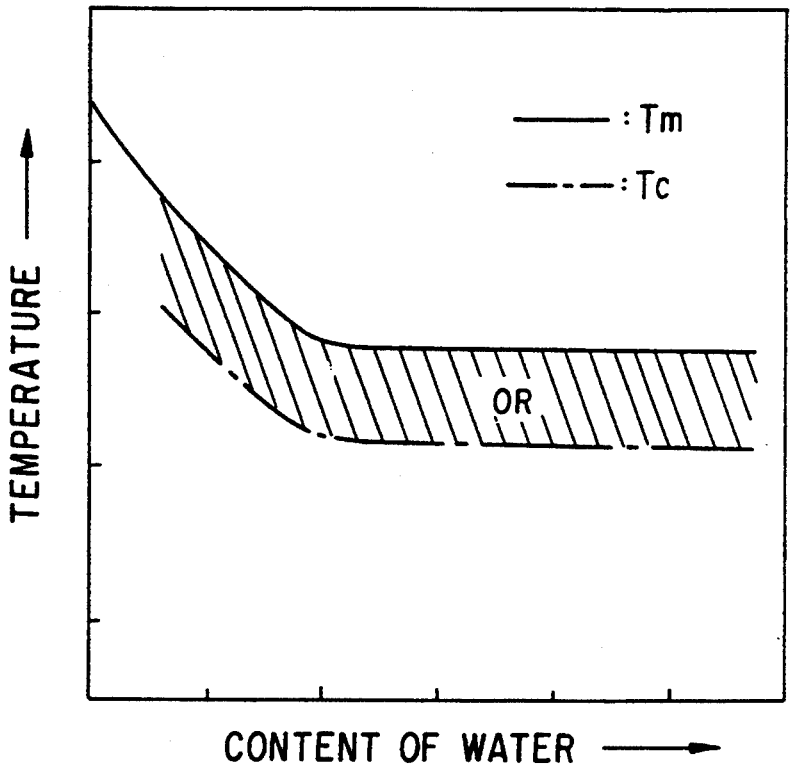
FIG. 2A is a graph illustrating typical changes in a melting temperature of the PAN/$H_2O$ mixture and a solidifying temperature of a melt thereof as a function of the water content, indicating the temperature region wherein the melted metacrystalline phase having a molecular order similar to that of a liquid crystal is formed.
Figure 4:
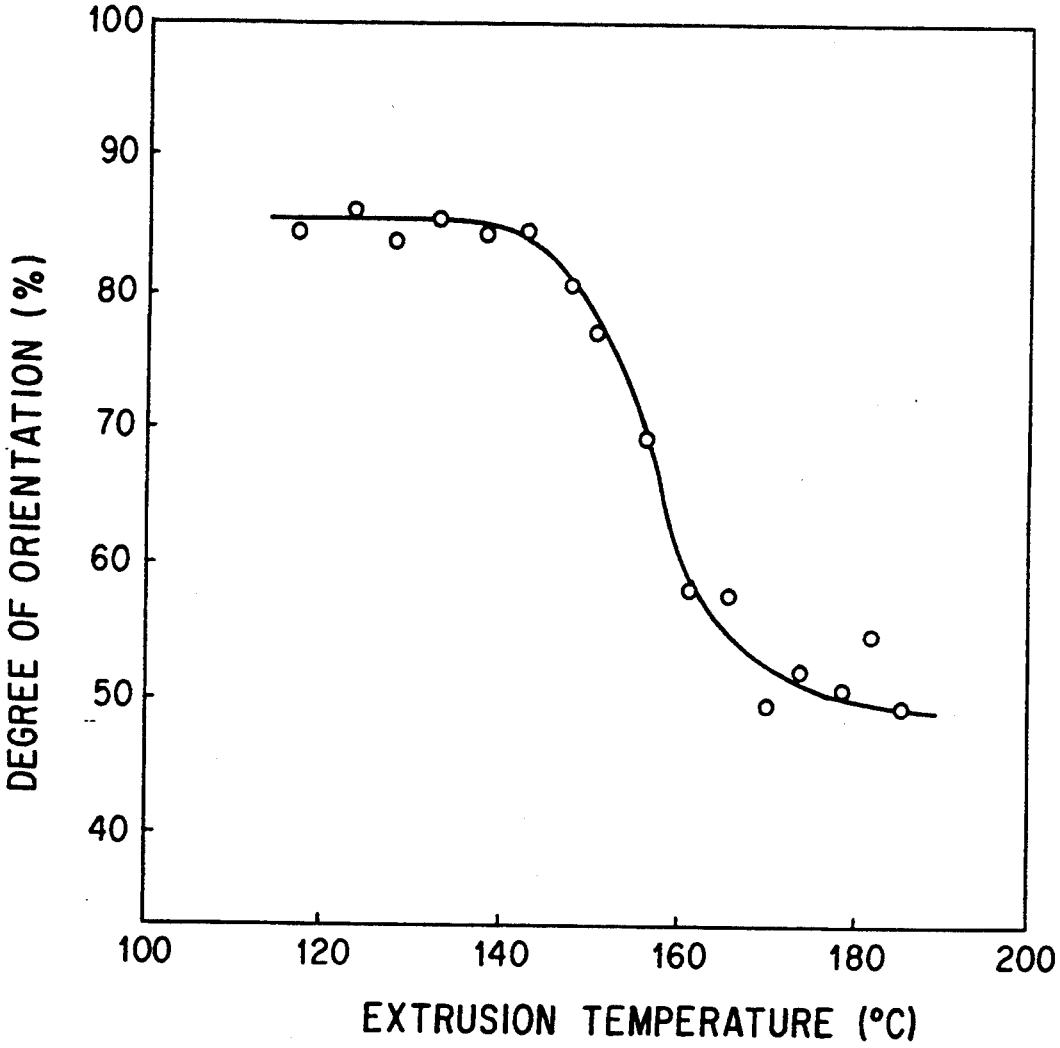
FIG. 4 is a graph illustrating the degree of orientation of the extrudate produced by extruding the melt of the PAN/H20 mixture as a function of the extrusion temperature, showing that the extrudate is scarcely oriented, i.e., the degree of orientation acquired is about 50%, in the temperature range at which an amorphous melt is formed, while the extrudate has high molecular orientation, i.e., the degree of orientation acquired is above 80%, in the temperature range at which a metacrystalline phase is formed.

The resulting melt is a random amorphous fluid. If the amorphous melt is cooled to and is maintained at a temperature between the melting temperature and the solidifying temperature as indicated in FIG. 2A, the supercooled melt of the metacrystalline phase, which has similar characteristics to a liquid crystal, is formed. It is believed that the melted metacrystalline phase is a kind of the supercooled melt which is prosecuted in the form of a fluid without being solidified even at the melting temperature or lower and which has not a random amorphous phase but a regular phase having a molecular order. It appears that in this regular phase the extended PAN molecular chains are aligned in parallel with each other by the interaction between the PAN molecular chains and water. The regular phase has the self-molecular orientating property as seen in a liquid crystal. That is, as shown in FIG. 4, if extrusion is carried out at an elevated temperature at which the amorphous melt is formed, substantially non-oriented extrudates having the degree of orientation of about 50% are formed. But, if it is carded out at a lower temperature of the melted metacrystalline phase, a high degree of orientation of more than 80% is accomplished under the same extrusion conditions.

Figure 3:
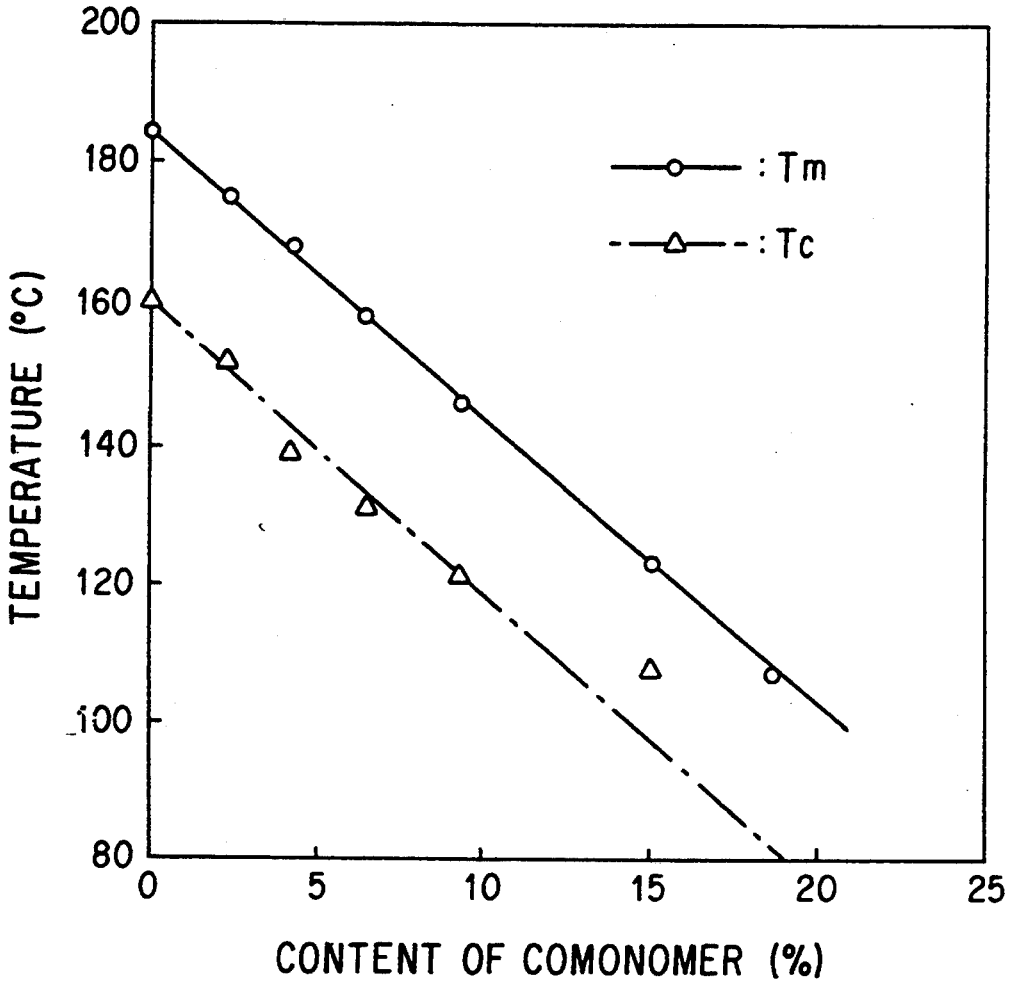
FIG. 3 is a graph illustrating changes in a melting temperature of the PAN/$H_2O$ mixture and a solidifying temperature of a melt thereof as a function of the content of methylacrylate as a comonomer, indicating that as the methylacrylate content in the acrylonitrile polymer increases, both the melting temperature and the solidifying temperature as stated above are lowered.

Such a temperature range which can form the melted metacrystalline phase having a molecular order depends on the content of acrylonitrile in PAN as shown in FIG. 3, or the amount of water in the hydrate as shown in FIG. 2A. The temperature is always in the range between the melting temperature (Tm) and the solidifying temperature (Tc), as indicated in FIG. 1A. When the PAN/$H_2O$ melt is formed, the pressure to be applied to a pressure vessel may be water vapor pressure which is spontaneously generated depending on the relevant temperature, or the vessel may be pressurized with from 1 to 50 atm.

The preferred content of water to be contained in the melt is in the range of 5% to 100% by weight, more preferably, 10% to 50% by weight.

Figure 5A:
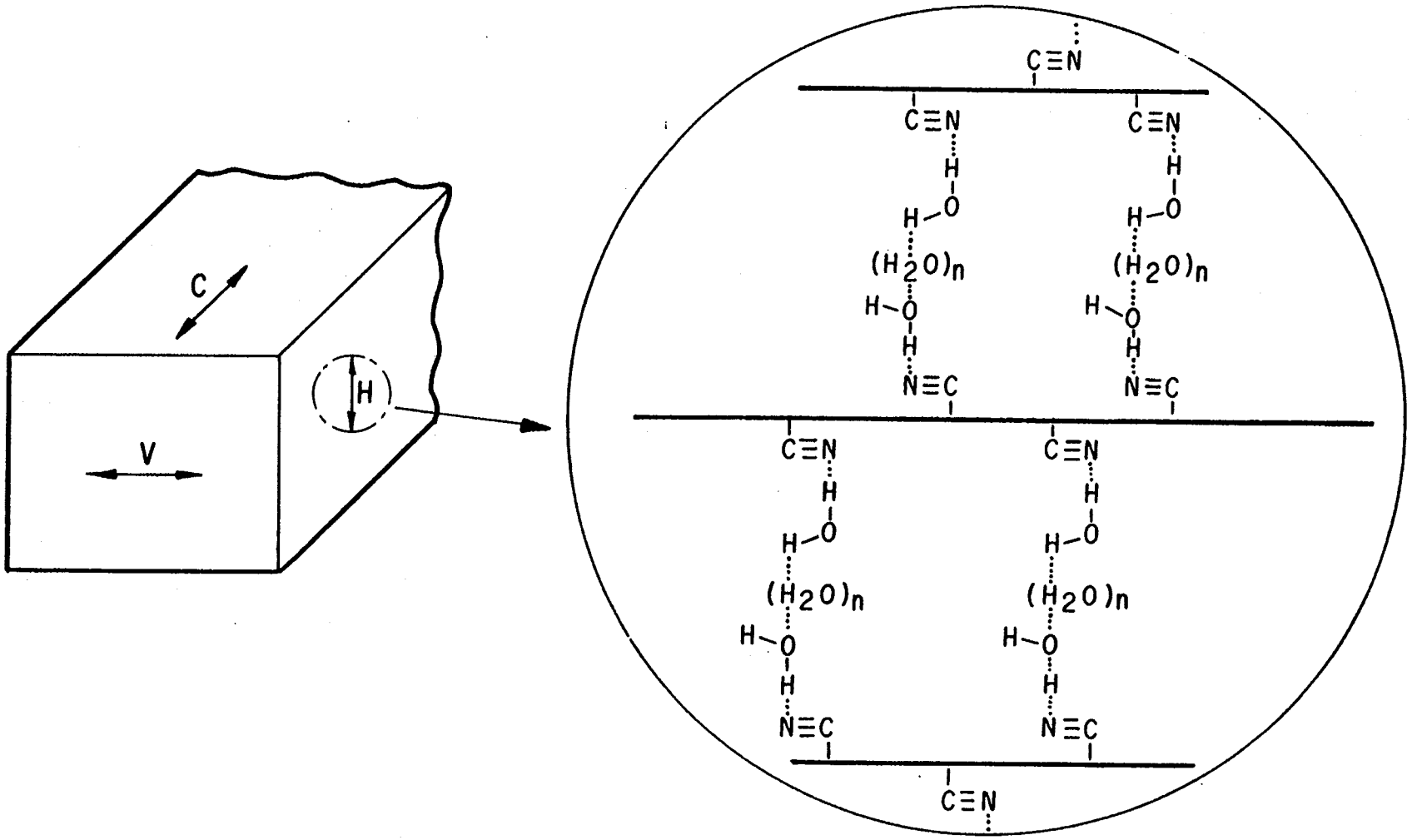
FIG. 5A illustrates the structural model of a three-dimensional molecular order of acrylonitrile polymer chains formed by the interaction of the acrylonitrile polymer chains with water molecules when the acrylonitrile polymer hydrate of the metacrystalline phase is extruded in a melted state.
Figure 5B:
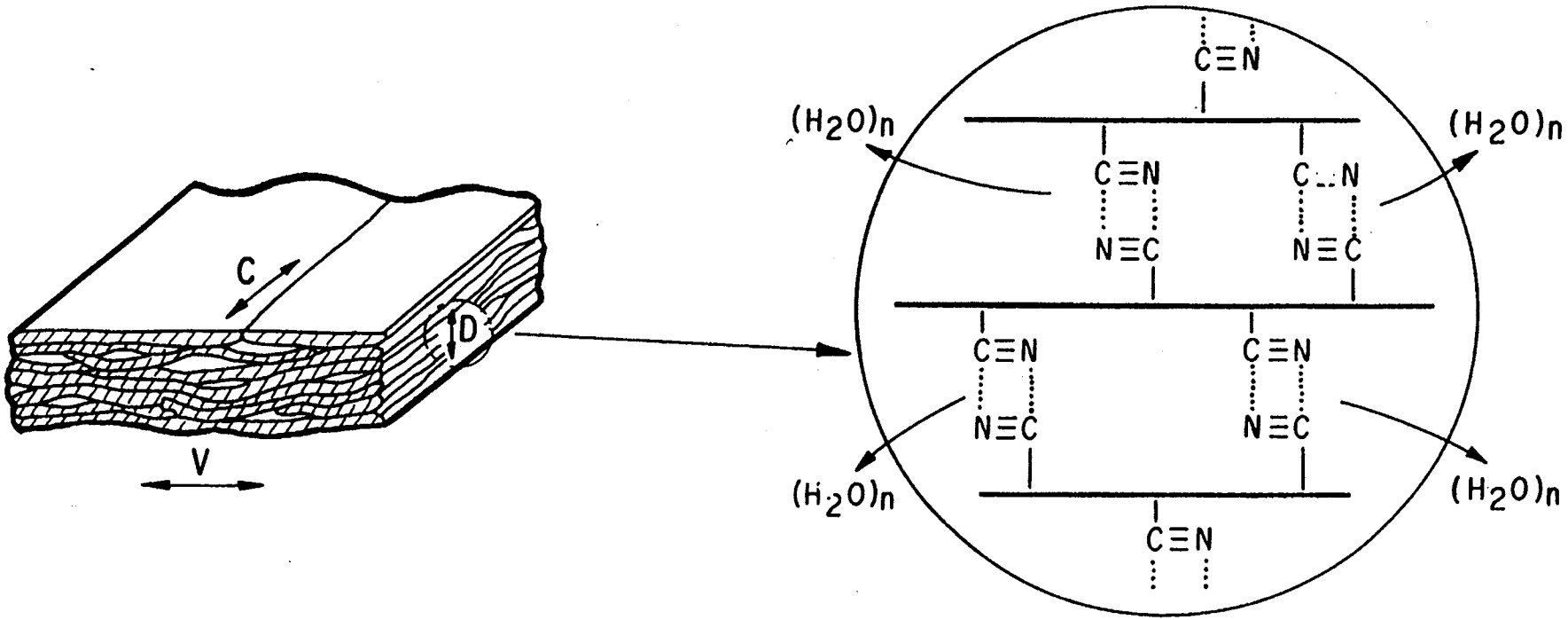
FIG. 5B illustrates the structural model of acrylonitrile polymer chains in which when fibers are formed by extrusion and solidification, the acrylonitrile polymer chains form platen fibrils in the extended chain conformation. The polymer chains are extended in the arrow "C" direction and a Van der Waals Force acts in the arrow "V" direction. After water is drained away from the melted metacrystalline phase, the phase shrinks to form fibers and a dipole attraction between nitrile groups acts in the arrow "D" direction in lieu of the hydrogen bonding force which acts in the arrow "H" direction in the melted metacrystalline phase.

Since in the random amorphous PAN/$H_2O$ melt, the individual molecular chains move more freely, the molecular chains are irregularly conglomerated and thus the molecules fail to establish the molecular order. If the amorphous melt is cooled to and is maintained within a proper temperature range, the individual molecular chains are subject to restriction in their movement and are bound, due to the intermolecular attraction existing between the PAN molecular chain and water, and thereby, the molecular chains form an extended chain conformation and are arranged orderly in parallel with adjacent molecular chains to form the melted metacrystalline phase, in which the mutual distance of molecules is maintained constantly. Since, in such a melted metacrystalline phase, the PAN molecular chains continue to maintain their molecular order, it is difficult for the individual molecular chains to move independently. But, when the whole molecular chains which form the regular phase are moved in a selected direction, it appears that PAN molecular chains are easy to have a three-dimensional orientation structure, as shown in FIG. 5A. Thus, as in FIG. 5B, it is easy to arrange the extended molecular chains of the melted metacrystalline phase having a molecular order in a selected direction and solidify them. That is, fibers having a high degree of molecular orientation are easy to be produced from the melted metacrystalline phase. On the other hand, since, in the amorphous melt, the individual PAN molecular chains move freely, the molecular order between molecular chains cannot be formed as well as molecular chains as such are freely wrinkled and are in existence as they are conglomerated, and thus it is impossible to arrange the molecular chains in a selected direction.

Since the supercooled melt of the metacrystalline phase according to the invention has a self-molecular orientating property as seen in a liquid crystal, the PAN molecular chains can form a fibrous structure of a high degree of orientation and highly-oriented extrudates having a cross-sectional structure in which platen fibrils are laminated in such a manner that the dehydration space is retained between the platen fibrils are formed, only by simple extrusion processing using a piston extruder.

In addition to the piston extruder, a screw extruder may be used as an extruder. A slit die, a tube die or an arc-shaped die may be optionally employed as an extrusion die. The preferred extrusion dies are those having a larger width than its thickness and a longer length. Extrusion temperature is maintained at the constant temperature between a melting temperature of the PAN/$H_2O$ mixture and a solidifying temperature of a melt thereof. Extrusion conditions are controlled so that the internal pressure of the extruder is maintained at least at a spontaneously generated water vapor pressure so as to extrude the melt into the atmosphere at room temperature and under the normal pressure at an output rate of 1 mm per second and to wind the resulting continuous extrudates at the linear rate not less than the output rate. In this case, in order to increase the extrusion rate, it is required to apply higher pressure to the inside of the extruder and to increase the winding rate.

The higher winding rate is advantageous in improving the degree of orientation.

Figure 6:
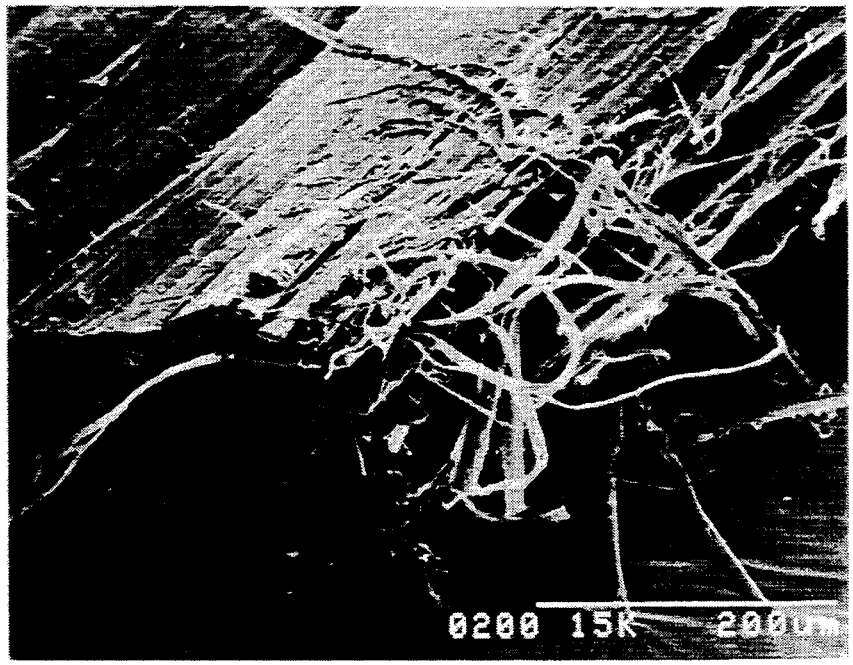
FIG. 6 is a photomicrograph from a scanning electron of the cross-section and the longitudinal section of the tape-shaped extrudate from which is formed by extruding the metacrystalline phase. The extrudate has the sectional structure on the cross-section in which platen fibrils are laminated in such a manner that the space from which water has been evaporated off (the "dehydration space") is retained between the platen fibrils and the internal structure on the longitudinal section in which the individual fibrils are redivided into microfibrils to form fibrous structure.
Figure 7:
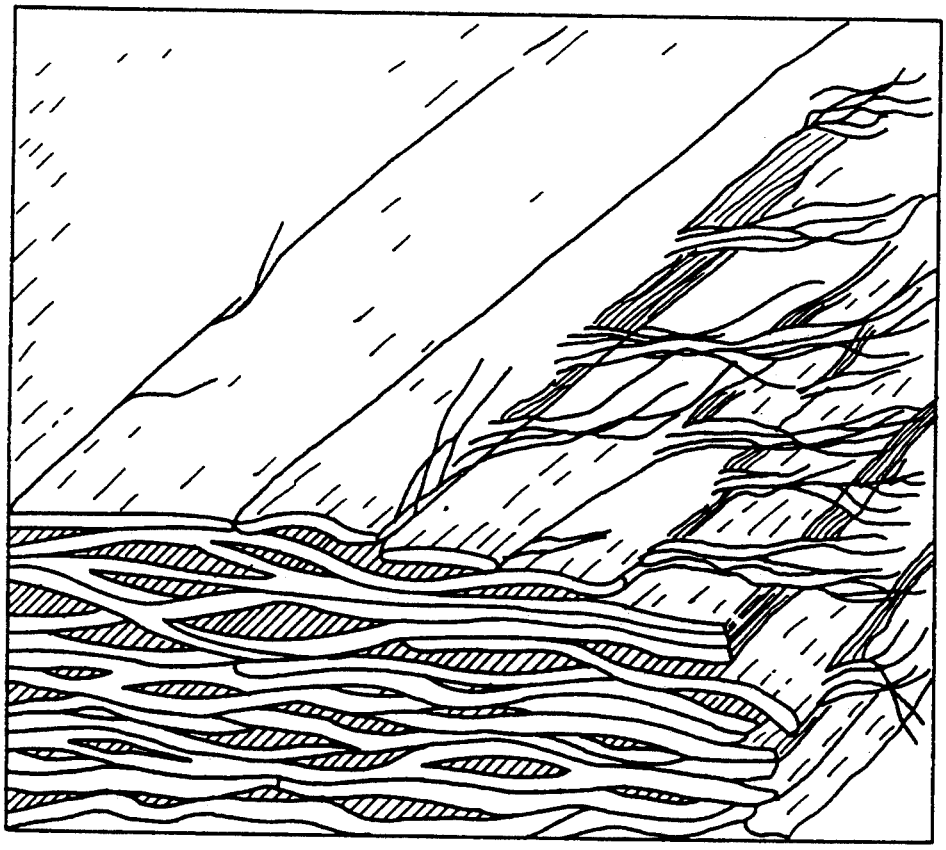
FIG. 7 illustrates a model of the cross-sectional structure and the longitudinal section structure of the tape-shaped extrudate of FIG. 6. It can be seen that the extrudate has the sectional structure on the cross-section in which platen fibrils are laminated at proper intervals in such a manner that the dehydration space is retained between the platen fibrils, and the internal structure on the longitudinal section in which the individual platen fibril consist of numerous microfibrils and that these fibrils and microfibrils are easily divided into their individuals to form a separate fiber.

Extrusion of the melt of the metacrystalline phase and then solidification of the resulting extrudate provides tape-shaped extrudates which consists of microfiber bundles and have a sectional structure on the cross-section which shows that platen fibrils are arranged in the direction of extrusion and are laminated in such a manner that the space from which water is evaporated off, i.e., dehydration space is retained between the platen fibrils, and an internal structure on the longitudinal section which shows that the individual fibrils are divided into microfibrils to form fibers, as illustrated in FIG. 6.

Figure 8:
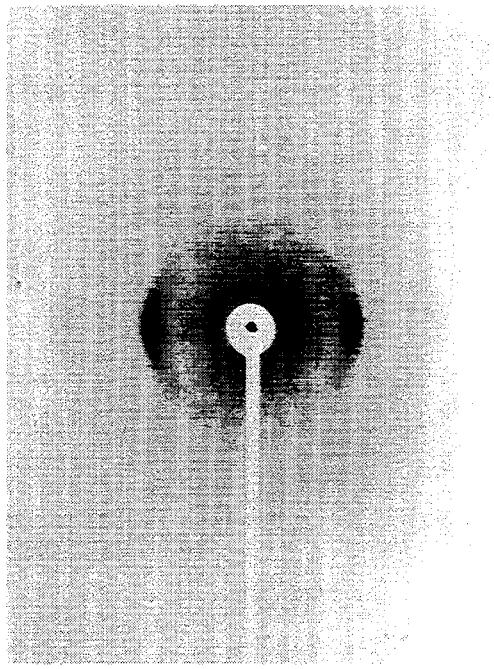
FIG. 8 illustrates an X-ray diffraction pattern of the tape-shaped extrudate of FIG. 6, showing that a fibrous crystal and highly-oriented structure are formed.
Figure 9:
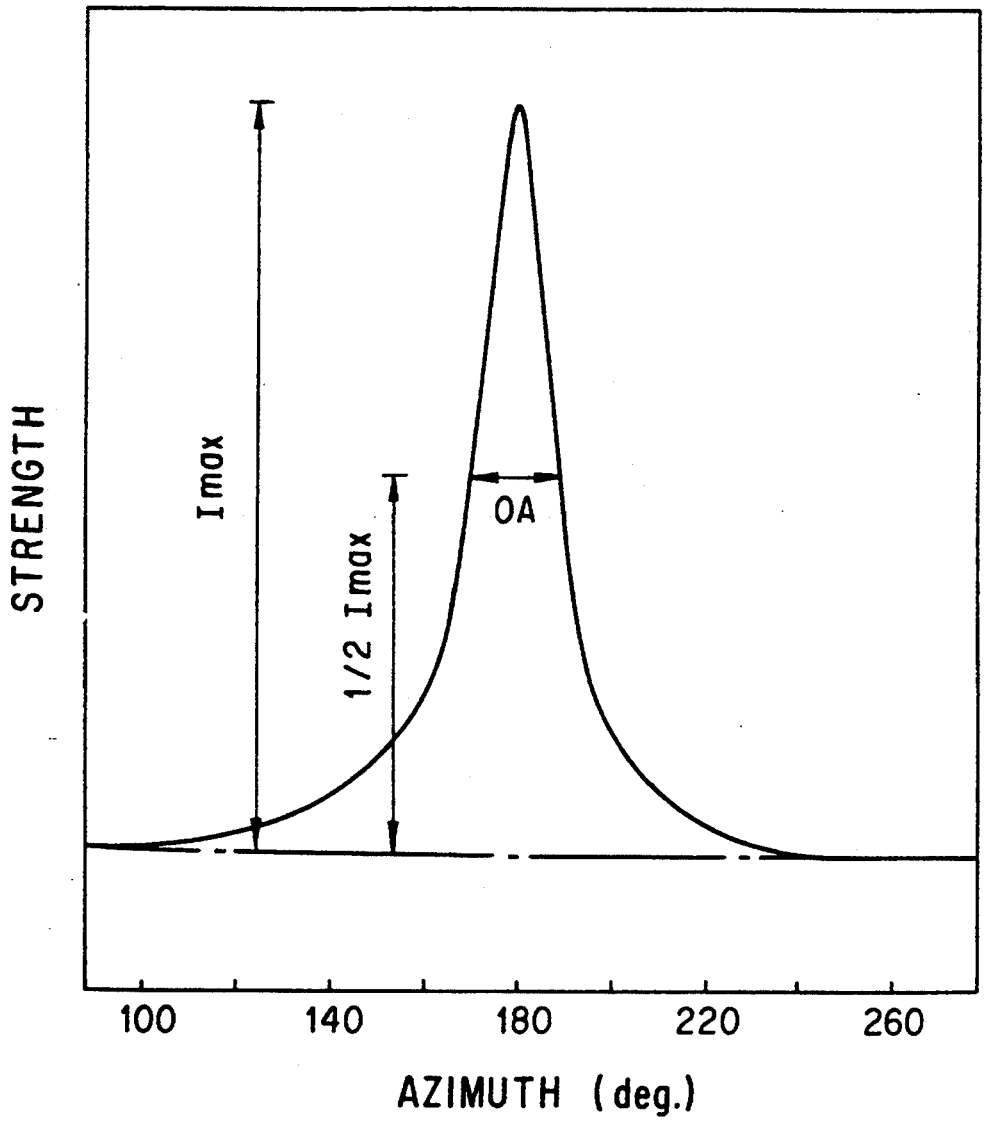
FIG. 9 illustrates a diffraction strength curve observed by an azimuthal scanning at the main diffraction peak ($2\theta = 16.2°$) on the X-ray diffraction pattern as illustrated in FIG. 8.

The fibrils are in a plate form having a thickness of 1 μm to 10 μm. A fibril is made up of microfibrils having a thickness of 0.01 μm to 1.0 μm, which are clustered tightly to form fibrils. The fibrils are also divided into individual microfibrils, which are the smallest unit of a fiber. It is identified from the X-ray diffraction pattern of the tape-shaped extrudate that the fibrils and the microfibrils each have the microstructure of a fibrous crystal and highly-oriented structure, as shown in FIG. 8.

The degree of orientation is a value calculated from the half-maximum width (OA) according to the following equation:

$$\text{Degree of orientation (\%)} = \frac{180 - OA}{180} \times 100$$

wherein OA is the peak width at the one half value of the diffraction strength as scanned in an azimuthal direction at the peak position (2=16.2°) of the main diffraction appeared in the direction of the, equator on the diffraction pattern. The degree of orientation of the extrudates according to the invention is above 70%.

Figure 10:
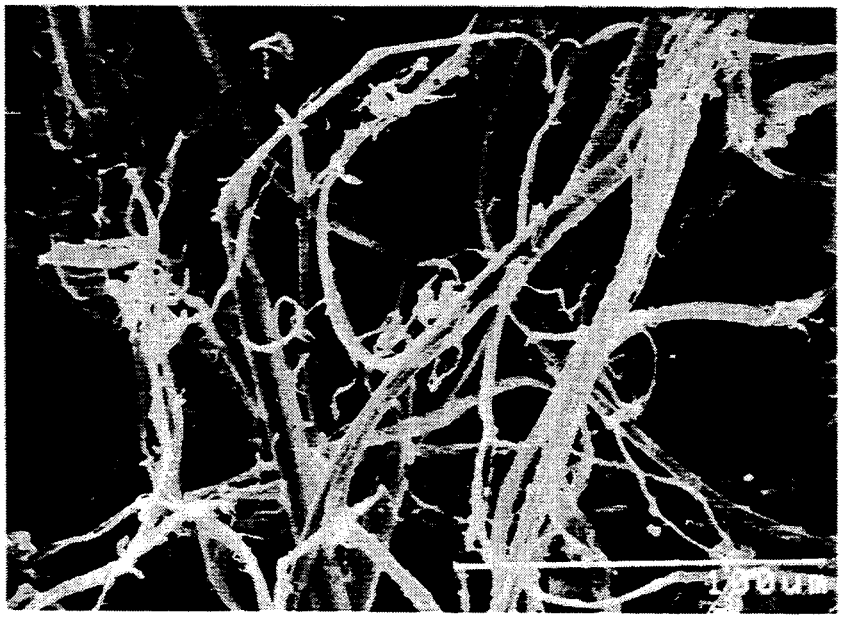
FIG. 10 is a photomicrograph from a scanning electron of the pulp-like short fibers produced by cutting the tape-shaped extrudate into an appropriate length followed by beating, showing that the individual fibers consist of fibrils and microfibrils and has an irregular, prolonged-oval section and several crevices and branches.

The fibrous extrudates, which are made up of highly-oriented fibrils prepared by the process according to the invention, are ready to be divided into the individual fibrils or microfibrils. The extrudates are cut to a random length and the cut extrudates are beated to provide pulp-like fibers as illustrated in FIG. 10. The size of the resulting fibers depends on the cutting length and beating conditions. The pulp-like short fibers produced are made up of fibrils and microfibrils, both of which have highly-oriented fiber structure. The cross-section of the short fibers is generally in the form of an irregular prolonged ellipse. The short fibers have many crevices and branches in the side. The fibers have a thickness of 0.1 μm to 100 μm and a length of 0.1 mm to 100 min. The individual fibers are made up of platen fibrils having a thickness of 1 μm to 10 μm and microfibrils having a thickness of 0.01 μm to 1.0 μm. The fine structure of the pulp-like short fiber is identified by the electron diffraction pattern derived from transmission electron microscope (TEM), and the pulp-like short fibers exhibit the fibrous crystal and highly-oriented structure, as in the tape-shaped extrudates before beating.

The phase change determined by differential scanning calorimetry, depending on the water content in hydrate, temperature and PAN composition, can provide information on the existence of the temperature region capable of forming the melted metacrystalline phase as illustrated in FIG. 1A and FIG. 2A. Since two component system consisting of PAN and water begins to change its phase at higher temperature than a boiling point of water under the normal pressure, it is possible to obtain the melting endothermic peak upon elevating the temperature and the solidifying exothermic peak upon cooling by using a large volume, pressure-resist capsule which is perfectly sealed and is capable of withstanding under high pressure (Perkin-Elmer part 3 19-0128).

As indicated in FIG. 1, when the apexes of the endothermic peak and the exothermic peak indicate the melting temperature (Tm) and the solidifying temperature (Tc), respectively, the temperature range between the melting temperature and the solidifying temperature corresponds to the region in which the melted metacrystalline phase is formed.

FIG. 2A shows the temperature region in which the melted metacrystalline phase is formed, depending on the change in water content of the hydrate. FIG. 3 illustrates an example showing the change of the region depending on the change in composition of PAN.

Figure 1B:
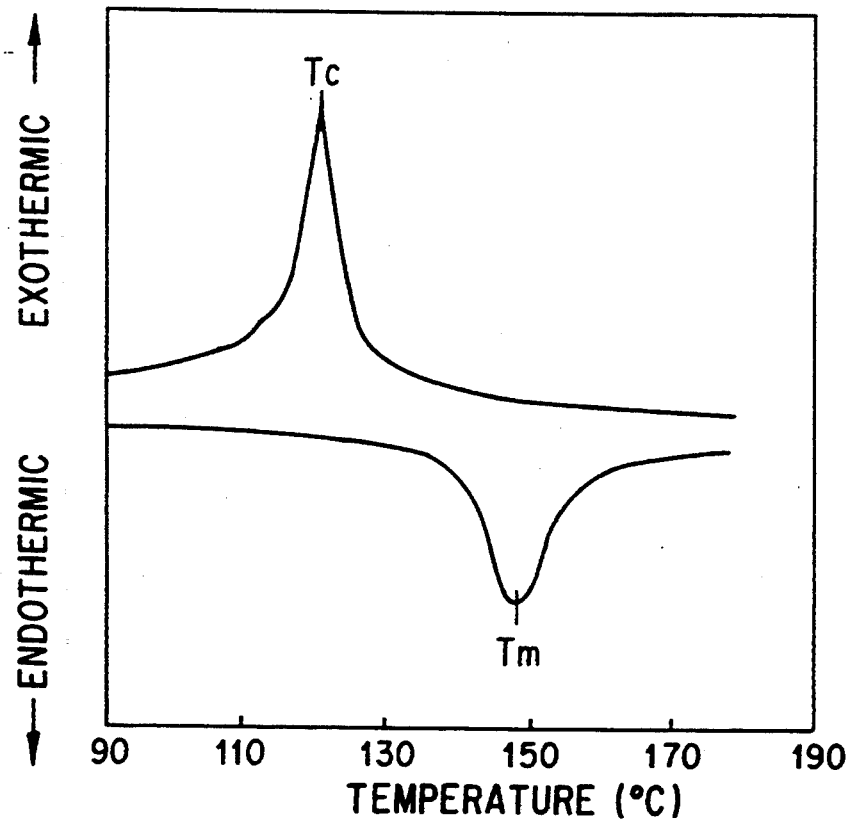
Fig. 1B is a graph which shows the melting endothermic peak and the solidifying exothermic peak of an embodiment of FIG. 1A, that is, a hydrate which contains a PAN copolymer composed of 89.2% by weight of acrylonitrile and 10.8% by weight of methylacrylate, in admixture with 20 parts by weight of water with respect to the total weight of PAN.
Figure 2B:
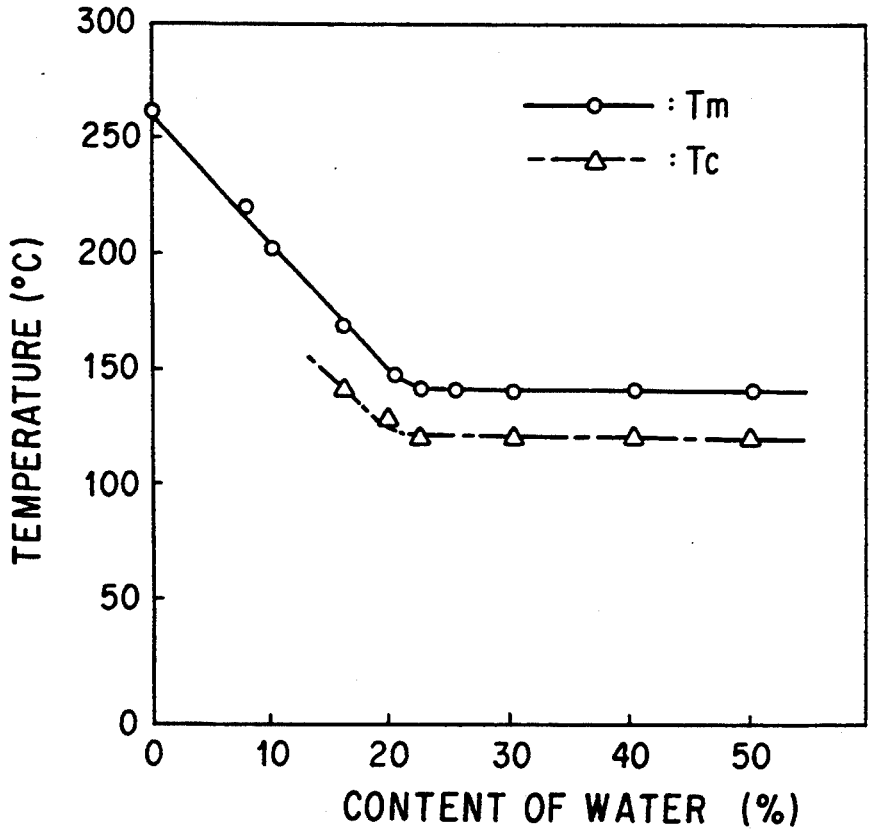
FIG. 2B illustrates changes in a melting temperature of the PAN/$H_2O$ mixture and a solidifying temperature of an embodiment of FIG. 2A, that is, a melt thereof that contains PAN consisting of 89.2% by weight of acrylonitrile and 10.8% by weight of methylacrylate as a function of the water content.

Figs. 1B and 2B show an embodiment of FIGS. 1A and 2A, respectively and illustrate the change of the temperature region in which the melted metacrystalline phase is formed, depending on the water content, wherein Fig. 1B is the case in which 20% by weight of water is mixed with PAN consisting of 89.2% by weight of acrylonitrile and 10.8% by weight of methacrylate, and FIG. 2B is the case in which the same PAN as in Fig. 1B is used, but the amount of water to be mixed is changed within the range of 5% to 50% by weight.

FIG. 4 illustrates a change in the degree of orientation depending on the extrusion temperature, which is obtained by extruding a PAN/$H_2O$ melt with the same extruder and under the same extrusion conditions, while changing only the extruding temperature, to obtain extrudates by the respective temperatures, and measuring the degree of orientation based on the X-ray diffraction for the respective extrudates. This shows that a high degree of orientation of PAN molecular chains can be easily accomplished only by small oriented shear forces generated by extrusion in the temperature range in which the melted metacrystalline phase according to the invention is formed, while the molecular orientation scarcely occurs in the elevated temperature at which an amorphous melt is formed.

According to the present invention, a new fiber, which has not been prepared hitherto, is provided by a process, which is wholly different from the conventional processes and which comprises forming a melted metacrystalline phase having a molecular order similar to that of a liquid crystal in a PAN/$H_2O$ melt, and producing fibers from the resulting metacrystalline phase melt. In accordance with the invention, the melted metacrystalline phase allows to produce fibers, the molecular orientation of which is excellent than that of the conventional highly-drawn fibers, without spinning and drawing since when extruded through a extrusion die having a large cross-sectional area into a tape form, PAN molecular chains can be easily oriented only by small oriented shear forces.

According to the invention, pulp-like acrylic short fibers are produced by a simple, epoch-making technique comprising melting PAN containing a small amount of water as a comelting material and extruding the resulting melt. Thus, costs of production are greatly reduced as compared with conventional techniques, and pollution problem is solved of itself. Short fibers per se produced according to the invention are characterized by the structure consisting of highly-oriented fibrils.

As for the performance, the physical properties of the fiber according to the invention are superior as compared with those of the conventional fibers due to a high degree of molecular orientation. The fibers of the invention also consist of innumerable microfibrils, and thus, the surface area thereof is very large. The fibers according to the invention have an irregular cross-sections in a plane taken perpendicular to the fiber axis and needle point-like ends similar to those of natural wood pulp fibers. Thus, the binding property with other materials is extremely enhanced. Moreover, the fibers of the invention can be mixed completely with natural wood pulp fibers over the whole mixing range of 1 to 99% ratios and can be dispersable completely in water. Such pulp-like short fibers of the invention have the optimum requirements as a short fiber material to be used as an industrial material, such as a composite material, a heat insulating and resisting material, a cement reinforcing material and the like. Particularly, since pulp-like short fibers are produced at very low cost by a simple process, they can be used without difficulty even as paper raw materials on behalf of wood pulp. Further, since the pulp-like short fibers consist of fine fibrils, and have an irregular prolonged oval section and numerous crevices and branches in the side, they have satisfactory characteristics as pulp to be used in paper-making. The most important feature is that the fibers of the invention have none of cylindrically-shaped filament trunk which is inevitable for the pulp-like fibers made by conventional spinning method followed by beating.

DESCRIPTION OF THE PREFERRED EMBODIMENTS

The invention will be illustrated in greater detail by way of the following examples. The examples are presented for illustrative purposes and should not be construed as limiting the invention which is properly delineated in the claims.

EXAMPLE 1

A mixture of 22 g of water and 100 g of an acrylonitrile copolymer consisting of 92.8% of acrylonitrile and 7.2% of methylacrylate and having a viscosity average molecular weight of 102,000 was placed into a cylinder of an extruder equipped with a cylinder, a piston and a slit die and being able to be sealed and to be heated and kept constant temperature, and was heated to a temperature of 175° C. under applied pressure of 5 kg/cm$^2$ to form a complete melt. Then, the temperature of the extruder was reduced to 148° C. and maintained at this temperature, and then the melt was pressurized to 60 kg/cm$^2$ by operating the piston and extruded through a slit die having 2.25 mm/20 mm/3 mm in thickness/-width/length into the atmosphere at room temperature and under the normal pressure to produce continuous tape-shaped extrudates, which were wound up at the rate of 2.0 meters per minute. The structure of the produced extrudates was observed using scanning electron microscope. The observation showed that the extrudates had a sectional structure in which platen fibrils having a thickness of 1 μm to 10 μm were laminated in such a manner that the dehydration space is retained between the platen fibrils, and an internal structure in which the individual fibrils were divided into innumerable microfibrils having a thickness of 0.01 μm to 1.0 μm. According to X-ray diffraction analysis, the tape-shaped extrudates had a fibrous crystal structure and showed the degree of orientation of 89%. Continuous tape-shaped extrudates were divided into and made thin in the direction of length to form long fibers. Mechanical properties of the resulting long fibers were measured. The results were as follows: tensile strength, 4.5 g/denier; elongation, 11%; and modulus, 67 g/denier. The short fibers produced thus possessed a thickness distribution of 0.1 μm to 20 μm and a length distribution of 1 mm to 20 min.

EXAMPLE 2

A mixture of 30 g of water and 100 g of an acrylonitrile homopolymer having a viscosity average molecular weight of 93,000 was placed into a cylinder of an extruder equipped with a cylinder, a piston and a slit die and being able to be sealed and to be heated and kept constant temperature, and was heated to a temperature of 205° C. under applied pressure of 5 kg/cm$^2$ to form a complete melt. Then, the temperature of the extruder was reduced to 178° C. and maintained at this temperature, and then the melt was pressurized to 70 kg/cm$_2$ by operating the piston and extruded through a slit die having 0.35 mm/20 mm/4 mm in thickness/width-/length into the atmosphere at room temperature and under the normal pressure to produce continuous tape-shaped extrudates, which were wound up at the rate of 1.5 meters per minute. X-ray diffraction analysis of the tape-shaped extrudates showed that the extrudates had a fibrous crystal structure and the degree of orientation of 88%. The continuous tape-shaped extrudates were divided into and made thin in the direction of length to form long fibers. Mechanical properties of the resulting long fibers were measured. The results were as follows: tensile strength, 4.8 g/denier; elongation, 10%; and modulus, 75 g/denier. The continuous tape-shaped extrudates were cut to the length of 15 mm, followed by beating by beater to produce pulp-like short fibers. The short fibers produced thus possessed a thickness distribution of 0.1 μm to 30 μm and a length distribution of 1 mm to 15 min.

EXAMPLE 3

A mixture of 25 g of water and 100 g of an acrylonitrile copolymer consisting of 94.2% of acrylonitrile and 5.8% of methylacrylate and having a viscosity average molecular weight of 178,000 was placed into a cylinder of an extruder equipped with a cylinder, a piston and a slit die and being able to be sealed and to be heated and kept constant temperature, and was heated to a temperature of 180° C. under applied pressure of 5 kg/cm$_2$ to form a complete melt. Then, the temperature of the extruder was reduced to 155° C. and maintained at this temperature, and then the melt was pressurized to 60 kg/cm$^2$ by operating the piston and extruded through a slit die having 0.25 mm/20 mm/3 mm in thickness/-width/length into the atmosphere at room temperature and under the normal pressure to produce continuous tape-shaped extrudates, which were wound up at the rate of 2.0 meters per minute. X-ray diffraction analysis of the tape-shaped extrudates showed that the tape-shaped extrudates had a fibrous crystal structure and the degree of orientation of 90%. The continuous tape-shaped extrudates were divided into and made thin in the direction of length to form long fibers. Mechanical properties of the resulting long fibers were measured. The results were as follows: tensile strength, 4.8 g/denier; elongation, 11%; and modulus, 70 g/denier. The continuous tape-shaped extrudates were cut to the length of 20 mm, followed by beating by beater to produce pulp-like short fibers. The short fibers produced thus possessed a thickness distribution of 0.1 μm to 20 μm and a length distribution of 1 mm to 20 min.

EXAMPLE 4

A mixture of 25 g of water and 100 g of an acrylonitrile copolymer consisting of 88.6% of acrylonitrile and 11.4% of methylacrylate and having a viscosity average molecular weight of 215,000 was placed into a cylinder of an extruder equipped with a cylinder, a piston and a slit die and being able to be sealed and to be heated and kept constant temperature, and was heated to a temperature of 175° C. under applied pressure of 5 kg/cm$^2$ to form a complete melt. Then, the temperature of the extruder was reduced to 145° C. and maintained at this temperature, and then the melt was pressurized to 70 kg/cm$^2$ by operating the piston and extruded through a slit die having 0.40 mm/20 mm/4 mm in thickness/-width/length into the atmosphere at room temperature and under the normal pressure to produce continuous tape-shaped extrudates, which were wound up at the rate of 1.0 meter per minute. X-ray diffraction analysis of the continuous tape-shaped extrudates showed that the tape-shaped extrudates had a fibrous crystal structure and the degree of orientation of 85%. The continuous tape-shaped extrudates were divided into and made thin in the direction of length to form long fibers. Mechanical properties of the resulting long fibers were measured. The results were as follows: tensile strength, 5.1 g/denier; elongation, 10%; and modulus, 63 g/denier. The continuous tape-shaped extrudates were cut to the length of i0 mm, followed by beating by beater to produce pulp-like short fibers. The short fibers produced thus possessed a thickness distribution of 0.1 μm to 4 μm and a length distribution of 1 mm to 10 min.

EXAMPLE 5

A mixture of 26 g of water and 100 g of an acrylonitrile copolymer consisting of 94.8% of acrylonitrile and 5.2% of vinylacetate and having a viscosity average molecular weight of 97,000 was placed into a cylinder of an extruder equipped with a cylinder, a piston and a slit die and being able to be sealed and to be heated and kept constant temperature, and was heated to a temperature of 180° C. under applied pressure of 5 kg/cm$^2$ to form a complete melt. Then, the temperature of the extruder was reduced to 155° C. and maintained at this temperature, and then the melt was pressurized to 65 Kg/cm$^2$ by operating the piston and extruded through a slit die having 0.30 mm/15 mm/4 mm in thickness/-width/length into the atmosphere at room temperature and under the normal pressure to produce continuous tape-shaped extrudates, which were wound up at the rate of 1.8 meters per minute. X-ray diffraction analysis of the continuous tape-shaped extrudates showed that the tape-shaped extrudates had a fibrous crystal structure and the degree of orientation of 88%. The continuous tape-shaped extrudates were divided into and made thin in the direction of length to form long fibers. Mechanical properties of the resulting long fibers were measured. The results were as follows: tensile strength, 3.8 g/denier; elongation, 12%; and modulus, 62 g/denier. The continuous tape-shaped extrudates were cut to the length of 10 mm, followed by beating by beater to produce pulp-like short fibers. The short fibers produced thus possessed a thickness distribution of 0.1 μm to 30 μm and a length distribution of 1 mm to 10 mm.

EXAMPLE 6

A mixture of 20 g of water and 100 g of an acrylonitrile copolymer consisting of 83.8% of acrylonitrile and 16.2% of vinylacetate and having a viscosity average molecular weight of 176,000 was placed into a cylinder of an extruder equipped with a cylinder, a piston and a slit die and being able to be sealed and to be heated and kept constant temperature, and was heated to a temperature of 165° C. under applied pressure of 5 kg/cm$^2$ to form a complete melt. Then, the temperature of the extruder was reduced to 135° C. and maintained at this temperature, and then the melt was pressurized to 55 kg/cm$^2$ by operating the piston and extruded through a slit die having 0.25 mm/20 mm/3 mm in thickness/-width/length into the atmosphere at room temperature and under the normal pressure to produce continuous tape-shaped extrudates, which were wound up at the rate of 2.4 meters per minute. X-ray diffraction analysis of the continuous tape-shaped extrudates showed that the tape-shaped extrudates had a fibrous crystal structure and the degree of orientation of 83%. The continuous tape-shaped extrudates were divided into and made thin in the direction of length to form long fibers. Mechanical properties of the resulting long fibers were measured. The results were as follows: tensile strength, 3.2 g/denier; elongation, 14%; and modulus, 48 g/denier. The continuous tape-shaped extrudates were cut to the length of 15 mm, followed by beating by beater to produce pulp-like short fibers. The short fibers produced thus possessed a thickness distribution of 0.1 μm to 50 μm and a length distribution of 1 mm to 15 min.

EXAMPLE 7

A mixture of 21 g of water and 100 g of an acrylonitrile copolymer consisting of 89.5% of acrylonitrile and 10.5% of styrene and having a viscosity average molecular weight of 126,000 was placed into a cylinder of an extruder equipped with a cylinder, a piston and a slit die and being able to be sealed and to be heated and kept constant temperature, and was heated to a temperature of 170° C. under applied pressure of 5 kg/cm$^2$ to form a complete melt. Then, the temperature of the extruder was reduced to 142° C. and maintained at this temperature, and then the melt was pressurized to 55 kg/cm$^2$ by operating the piston and extruded through a slit die having 0.3 mm/20 mm/4 mm in thickness/width-/length into the atmosphere at room temperature and under the normal pressure to produce continuous tape-shaped extrudates, which were wound up at the rate of 2.0 meters per minute. X-ray diffraction analysis of the continuous tape-shaped extrudates showed that the tape-shaped extrudates had a fibrous crystal structure and the degree of orientation of 84%. The continuous tape-shaped extrudates were divided into and made thin in the direction of length to form long fibers. Mechanical properties of the resulting long fibers were measured. The results were as follows: tensile strength, 3.4 g/denier; elongation, 13%; and modulus, 52 g/denier. The continuous tape-shaped extrudates were cut to the length of 15 mm, followed by beating by beater to produce pulp-like short fibers. The short fibers produced thus possessed a thickness distribution of 0.1 μm to 40 μm and a length distribution of 1 mm to 15 min.

EXAMPLE 8

A mixture of 18 g of water and 100 g of an acrylonitrile copolymer consisting of 87.1% of acrylonitrile and 12.9% of methylmethacrylate and having a viscosity average molecular weight of 112,000 was placed into a cylinder of an extruder equipped with a cylinder, a piston and a slit die and being able to be sealed and to be heated and kept constant temperature, and was heated to a temperature of 170° C. under applied pressure of 5 kg/cm$^2$ to form a complete melt. Then, the temperature of the extruder was reduced to 140° C. and maintained at this temperature, and then the melt was pressurized to 50 kg/cm$^2$ by operating the piston and extruded through a slit die having 0.20 mm/20 mm/3 mm in thickness/width/length into the atmosphere at room temperature and under the normal pressure to produce continuous tape-shaped extrudates, which were wound up at the rate of 2.0 meters per minute. X-ray diffraction analysis of the continuous tape-shaped extrudates showed that the tape-shaped extrudates had a fibrous crystal structure and the degree of orientation of 87%. The continuous tape-shaped extrudates were divided into and made thin in the direction of length to form long fibers. Mechanical properties of the resulting long fibers were measured. The results were as follows: tensile strength, 4.2 g/denier; elongation, 12%; and modulus, 65 g/denier. The continuous tape-shaped extrudates were cut to the length of 10 mm, followed by beating by beater to produce pulp-like short fibers. The short fibers produced thus possessed a thickness distribution of 0.1 μm to 30 μm and a length distribution of 1 mm to 10 min.

EXAMPLE 9

There was dispersed 65 g of the acrylic fiber obtained in each of Examples 1 to 8 in 13,100 g of water by vigorous beating. To each dispersion, 3.2 g of polyvinylalcohol as a binder was added. Wet spraying of the dispersion followed by drying at 80° C. gave a synthetic acryl paper of good quality.

EXAMPLE 10

There was dispersed 6 g of the acrylic fiber obtained in each of Examples 1 to 8 and 59 g of natural wood pulp fibers in 13,100 g of water by vigorous beating. All the acrylic fibers obtained in Examples 1 through 8 exhibited a complete miscibility with natural wood pulp fibers. To each dispersion, 0.3 g of polyvinylalcohol as a binder was added. Wet spraying of the dispersion followed by drying at 80° C. gave a paper of good quality.

COMPARATIVE EXAMPLE 1

For purposes of comparison, a mixture of 100 g of an acrylonitrile copolymer, which has a chemical composition of 92.8% of acrylonitrile and 7.2% of methylacrylate and a viscosity average molecular weight of 102,000, and 22 g of water was placed into the same extruder as employed in Example 1, and heated to 175° C. under applied pressures of 5 kg/cm$^2$ to form a complete melt. Then, the resulting melt was pressurized up to 60 kg/cm$^2$ by operating the piston and extruded through a slit die having 0.25 mm/20 mm/3 mm in thickness/width/length into the atmosphere at room temperature and under the normal pressure. The pulp-like short fibers were not produced from the resulting extrudates.

COMPARATIVE EXAMPLE 2

For purposes of comparison, a mixture of 100 g of an acrylonitrile copolymer, which has a chemical composition of 92.8% of acrylonitrile and 7.2% of methylacrylate and a viscosity average molecular weight of 102,000, and 22 g of water was placed into the same extruder as employed in Example 1, and heated to 175° C. under applied pressures of 5 kg/cm$^2$ to form a complete melt. Then, the resulting melt was pressurized up to 30 kg/cm$^2$ by operating the piston and extruded through a slit die having 0.25 mm/20 mm/3 mm in thickness/width/length into a pressure chamber under applied pressure of 2 kg/cm$^2$ at room temperature to form tape-shaped continuous extrudates, which were then wound up at the rate of 20 meters per minute. X-ray diffraction analysis of the continuous tape-shaped extrudates showed that the tape-shaped extrudates had the degree of orientation of 56%. It was impossible to produce pulp-like short fibers from the resulting extrudates.

What is claimed is:

1. A non-spun fiber of an acrylonitrile homopolymer or an acrylonitrile copolymer consisting of at least 70% by weight acrylonitrile and at most 30% by weight of one or more copolymerizable monomers, said acrylonitrile homopolymer or copolymer having a viscosity average molecular weight of 10,000 to 600,000characterized by: short pulp fiber form having a thickness distribution of 0.1 to 100 μm and a length distribution of 0.1 to 100 mm, irregular cross-sections in a plane taken perpendicular to the fiber axis, needle point-like ends similar to those of natural wood pulp fibers, a degree of orientation of more than 80% based on an X-ray analysis, a tensile strength of 3 to 10 g/denier and an initial modulus of 30 to 100 g/denier, and absolutely no cylindrically-shaped filament trunks.

2. The non-spun fiber according to claim 1, wherein the viscosity average molecular weight of the acrylonitrile homopolymer or copolymer is 50,000 to 350,000.

3. The non-spun fiber according to claim 1, wherein the acrylonitrile copolymer consists of at least 85% by weight acrylonitrile by weight and at most 15% by weight of one or more copolymerizable monomers.

* * * * *

UNITED STATES PATENT AND TRADEMARK OFFICE

CERTIFICATE OF CORRECTION

PATENT NO. : 5,434,002

DATED : July 18, 1995

INVENTOR(S) : Han S. YOON et al

It is certified that error appears in the above-identified patent and that said Letters Patent is hereby corrected as shown below:

Column 6, line 45, delete "809" and insert --80%--.

Column 9, line 33, delete "(2 = 16.2°)" and insert --(2θ = 16.2°)--.

Signed and Sealed this

Fourth Day of June, 1996

*Attest:*

*Attesting Officer*

BRUCE LEHMAN

*Commissioner of Patents and Trademarks*